US007085626B2

(12) United States Patent
Harrod et al.

(10) Patent No.: US 7,085,626 B2
(45) Date of Patent: Aug. 1, 2006

(54) METHOD AND APPARATUS TO PREVENT LOW TEMPERATURE DAMAGE USING AN HVAC CONTROL

(75) Inventors: Gregory Ralph Harrod, Wichita, KS (US); Jeffrey Lee Tucker, Wichita, KS (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 10/824,804

(22) Filed: Apr. 15, 2004

(65) Prior Publication Data

US 2005/0234597 A1 Oct. 20, 2005

(51) Int. Cl.

| | |
|---|---|
| ***G01M 1/38*** | (2006.01) |
| ***G05B 13/00*** | (2006.01) |
| ***G05B 15/00*** | (2006.01) |
| ***G05B 21/00*** | (2006.01) |
| ***F25B 29/00*** | (2006.01) |

(52) U.S. Cl. ..... 700/276; 165/241; 165/242

(58) Field of Classification Search ..... 700/276, 700/278, 299, 300; 165/240–242, 260–262; 236/1 E See application file for complete search history.

(56) References Cited

U.S. PATENT DOCUMENTS

| | | | | |
|---|---|---|---|---|
| 4,143,707 A | | 3/1979 | Lewis et al. | |
| 4,248,375 A | | 2/1981 | Whitney | |
| 4,262,736 A | * | 4/1981 | Gilkeson et al. | 165/11.1 |
| 4,265,299 A | * | 5/1981 | Harnish | 165/240 |
| 4,298,056 A | | 11/1981 | Nelson | |
| 4,334,576 A | | 6/1982 | Fuchek | |
| 4,373,664 A | | 2/1983 | Barker et al. | |
| 4,379,483 A | * | 4/1983 | Farley | 165/261 |
| 4,442,972 A | | 4/1984 | Sahay et al. | |
| 4,598,764 A | | 7/1986 | Beckey | |
| 4,627,483 A | | 12/1986 | Harshbarger, III et al. | |
| 4,971,136 A | * | 11/1990 | Mathur et al. | 165/240 |
| 5,165,465 A | | 11/1992 | Kenet | |
| 5,244,146 A | | 9/1993 | Jefferson et al. | |
| 5,259,445 A | | 11/1993 | Pratt et al. | |
| 5,488,218 A | * | 1/1996 | Olsen et al. | 165/240 |
| 5,839,886 A | * | 11/1998 | Shaw | 417/250 |
| 5,918,668 A | | 7/1999 | Trimble | |
| 6,729,390 B1 | * | 5/2004 | Toth et al. | 165/242 |

* cited by examiner

*Primary Examiner*—Leo Picard
*Assistant Examiner*—Ryan A. Jarrett
(74) *Attorney, Agent, or Firm*—McNees Wallace & Nurick LLC

(57) ABSTRACT

A heating control method is provided for a multi-stage heating system including a heating circuit having a compressor, a condenser and an evaporator. An auxiliary heater is provided that is selectively controlled independently of the heating circuit. During a heating cycle in which the ambient outside temperature is greater than the balance point temperature associated with the operation of the heating circuit, the auxiliary heating circuit is normally prevented from operating. However, if the heating requirements are not satisfied after a predetermined time or the compressor is non-functional or operating improperly, the auxiliary heater is enabled.

20 Claims, 4 Drawing Sheets

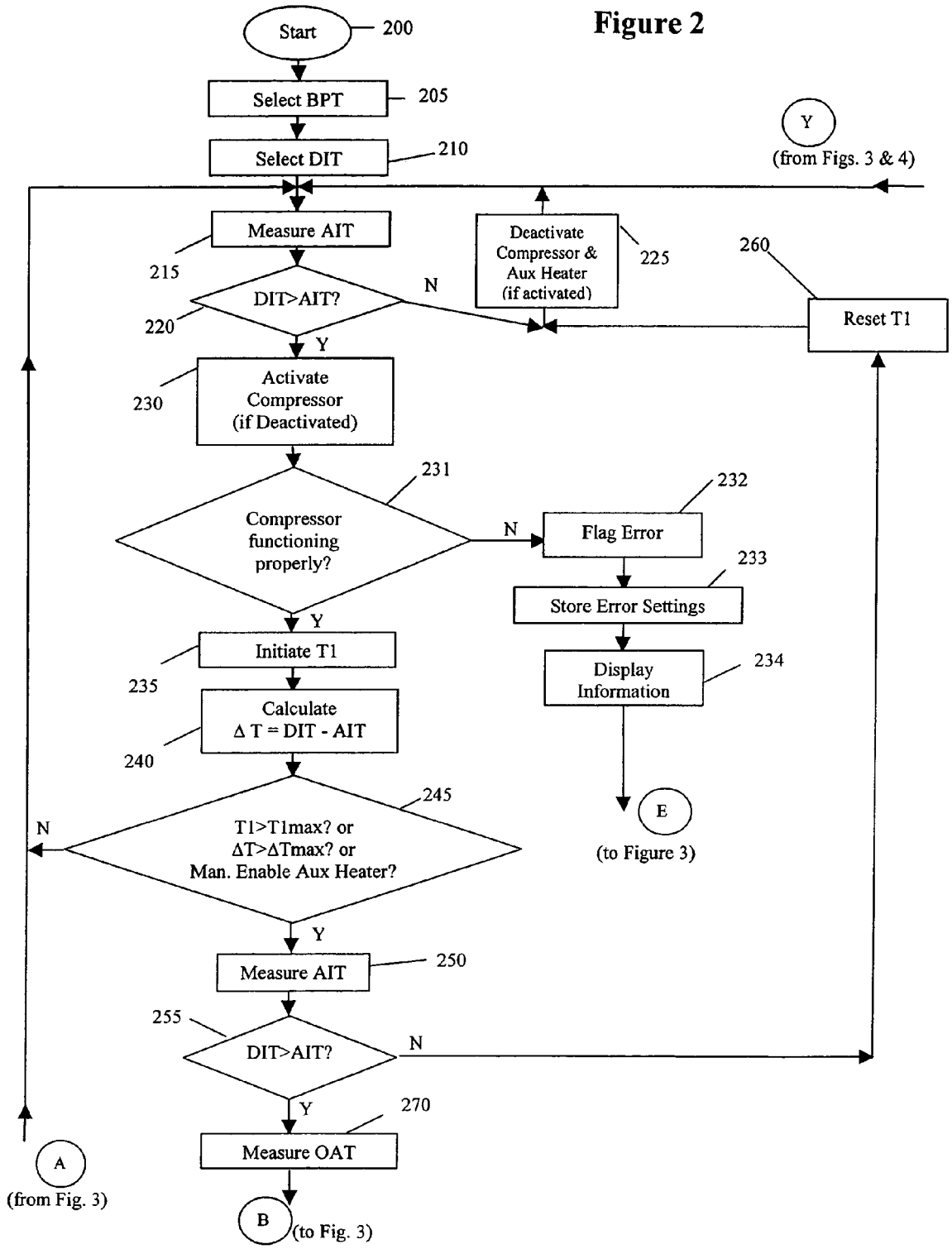
Figure 2
Start
200
Select BPT
205
Select DIT
210
Y
(from Figs. 3 & 4)
Measure AIT
215
DIT>AIT?
220
N
Y
Deactivate Compressor & Aux Heater (if activated)
225
260
Reset T1
Activate Compressor (if Deactivated)
230
Compressor functioning properly?
231
N
Flag Error
232
Store Error Settings
233
Display Information
234
E
(to Figure 3)
Y
Initiate T1
235
Calculate Δ T = DIT - AIT
240
T1>T1max? or ΔT>ΔTmax? or Man. Enable Aux Heater?
245
N
Y
Measure AIT
250
DIT>AIT?
255
N
Y
Measure OAT
270
A
(from Fig. 3)
B
(to Fig. 3)

METHOD AND APPARATUS TO PREVENT LOW TEMPERATURE DAMAGE USING AN HVAC CONTROL

BACKGROUND OF THE INVENTION

The present invention relates generally to a control application for a heating system. More specifically, the present invention relates to a method and apparatus for overriding the base controls of a heating system to provide heat from an auxiliary heat source.

Typically, heating systems have two independent heaters to provide heat to regulate the temperature of an interior space, such as a home. The first heater is a heat pump, and the second heater is an auxiliary heater. The auxiliary heater typically provides electrical resistance or fossil fuel heating. The electrical resistance heat may be in the form of electrically resistive wires positioned in a plenum of the heating system that generates heat in response to passing current through the wires. Air circulated past the heated wires in the plenum is likewise heated and circulated through the home. Alternately, the auxiliary heater may be in the form of electrical resistance baseboard heaters that are positioned throughout the home. The fossil fuel auxiliary heater receives and burns natural gas, oil or other fuel to provide heating to air in a plenum in the heating system that is circulated through the home. Additionally, the auxiliary heaters can be designed to provide two or more heating capacities, also commonly referred to as stages.

A heat pump's capacity to provide heat to a home decreases as the outside ambient temperature decreases. When the outside temperature is less than some preselected outdoor ambient temperature, typically referred to as the application balance point, auxiliary heat must be used with or in place of the heat pump to adequately heat the home. Additionally, when the outside temperature is less than a second preselected outdoor ambient temperature, heat pumps are a more expensive heating method than the auxiliary heater. This second preselected temperature is typically referred to as the economic balance point. This second preselected temperature depends on many factors including the efficiency of the heat pump, the type and efficiency of the auxiliary heater, the cost of electricity to operate the heat pump and the cost of fuel/electricity being used by the auxiliary heater. Ideally, the balance point used by the heating system is selected to be the higher of the application balance point and the economic balance point.

Depending upon the particular heat pump configuration, the heating system balance point can range considerably, from about 0° F. to about 45° F., for example. That is, if the heating system balance point is set considerably less than 32° F. and a problem occurs with the heat pump so that the heat pump cannot heat the home, there is the potential for significant damage to the home, such as from water pipes freezing. For example, if the heating system balance point temperature is set to 0° F. and the outdoor ambient temperature is 10° F., typical heating controls will not permit the auxiliary heater to operate because the outdoor ambient temperature is greater than the balance point temperature. If the heat pump malfunctions for any reason, i.e., failed power connection, internal compressor damage, etc., the home will not be heated. If the outside ambient temperature remains greater than the balance point temperature yet less than 32° F. for a sufficient period of time, pipe freezing may occur, especially if the homeowner is away during this period of time and unable to intervene.

What is needed is a method or apparatus for use with heating systems that can override the control system when the indoor room temperature is not being maintained as required, and the auxiliary heat is being prevented from operating by the balance point setting.

SUMMARY OF THE INVENTION

The present invention is directed to a method of providing heat for an interior space, the method including the steps of providing a HVAC system having a compressor, a condenser and an evaporator connected in a closed refrigerant loop; providing an auxiliary heater controllable independently of the HVAC system; operating the HVAC system to provide heat in response to a demand for heating in the interior space; comparing an ambient outside temperature with a predetermined balance point temperature associated with the HVAC system; and enabling the auxiliary heater in response to the ambient outside temperature being greater than the predetermined balance temperature and at least one of the HVAC system being operated for a predetermined time, and an indoor temperature of the interior space being less than a predetermined indoor temperature.

The present invention further includes a control system for selectively providing heat to an interior space including a control panel configured to control a HVAC system having a compressor, a condenser and an evaporator connected in a closed refrigerant loop, and an auxiliary heater controllable independently of the HVAC system, the control panel including: a first sensor to measure an ambient outside temperature; a second sensor to measure an indoor temperature of the interior space; a microprocessor; and a storage device storing a predetermined balance point temperature associated with the HVAC system. Wherein the microprocessor is configured to engage the auxiliary heater in response to the ambient outside temperature being greater than the predetermined balance point temperature and at least one of the HVAC system being enabled for a predetermined time or an indoor temperature of the interior space being less than a second predetermined temperature.

The present invention yet includes a HVAC system for an interior space, the HVAC system including a control panel configured to control the HVAC system having a compressor, a condenser and an evaporator connected in a closed refrigerant loop, and an auxiliary heater controllable independently of the HVAC system, the control panel including: a first sensor to measure an ambient outside temperature; a second sensor to measure an indoor temperature of the interior space; a microprocessor; and a storage device storing a predetermined balance point temperature associated with the HVAC system. Wherein the microprocessor is configured to engage the auxiliary heater in response to the ambient outside temperature being greater than the predetermined balance point temperature and at least one of the HVAC system being enabled for a predetermined time or an indoor temperature of the interior space being less than a second predetermined temperature.

One advantage of the present invention is that auxiliary heating is provided after a predetermined period of time in case the heat pump malfunctions, or is otherwise unable to provide sufficient heat.

Another advantage of the present invention is that the heating control can be incorporated into a thermostat.

A further advantage of the present invention is that it can be incorporated into a controller.

An additional advantage of the present invention is that damage to an interior space is significantly reduced due to an override of the control system that otherwise prevents the auxiliary heater from operating under circumstances in which damage may occur due to freezing pipes, etc.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIGS. 2–4 illustrate a flow chart detailing the heating control method of the present invention.

Wherever possible, the same reference numbers will be used throughout the drawings to refer to the same or like parts.

DETAILED DESCRIPTION OF THE INVENTION

Figure 1:
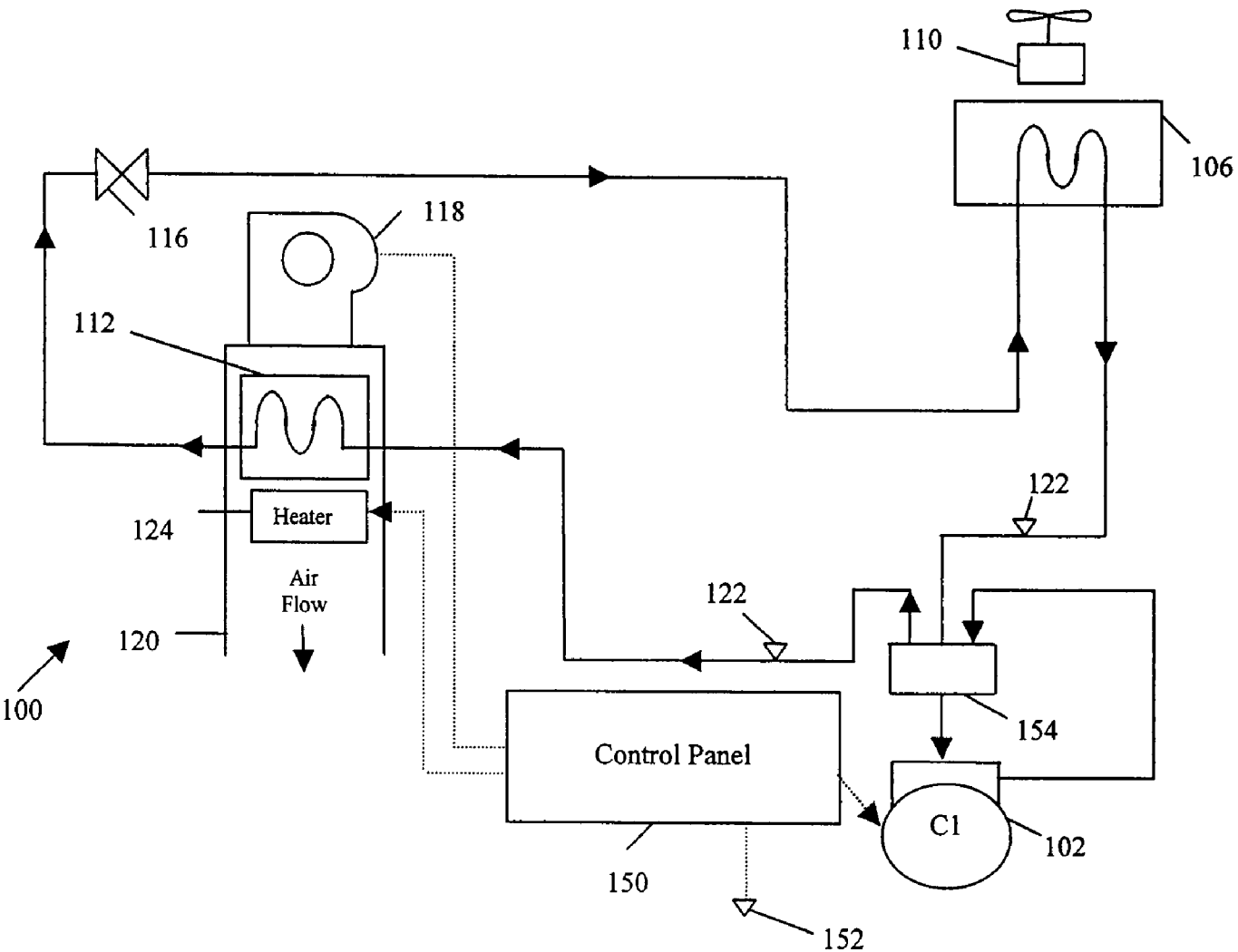
FIG. 1 illustrates schematically an embodiment of a heating, ventilation and air conditioning system for use with the present invention.

FIG. 1 illustrates one embodiment of a heating, ventilation and air conditioning (HVAC) system 100 for an interior space. The HVAC system 100 preferably includes a two-stage heating or cooling system using a two-stage compressor 102 to provide two (or more) levels of heating or cooling capacity in the interior space. Alternately, the compressor 102 can have a single stage or more than two stages. The compressor 102 can be a screw compressor, a reciprocating compressor, a scroll compressor, a centrifugal compressor or any other suitable type of compressor. The two levels of heating or cooling capacity can be obtained by operating the compressor 102 at a first stage or second stage, depending on the heating or cooling demand or load. The first level of heating or cooling capacity is obtained by operating the compressor 102 during periods of lower heating or cooling demand and the second level of heating or cooling capacity is obtained by operating the second stage of the compressor 102 during periods of higher heating demand. Furthermore, additional compressors can be used to provide additional levels of heating or cooling capacity or an auxiliary heater 124, such as electrical resistance heater or fossil fuel heater, can be provided as a supplemental heat source, which can be added to provide additional levels of heating capacity for the HVAC system 100.

The compressor when used to provide the first level of heating or cooling capacity can be referred to as a stage one or stage one compressor and when the compressor is operated to provide the second level of heating or cooling capacity, it can be referred to as a stage two or stage two compressor. To simplify the explanation of the present invention and to correspond to the HVAC system 100 as shown in FIG. 1, the HVAC system 100 is in the heating mode of operation and compressor 102 is activated at stage one, although it can be activated at stage two when additional heating is required. Furthermore, it is to be understood that cooling capacity can be provided by reversing the flow of refrigeration in FIG. 1 with a slide valve 154.

Additionally, for heating mode operation, a balance point temperature ("BPT") for the compressor 102 may be selected by the user, such as by inputting or entering the balance point temperature by keystroke sequence on the thermostat or by manipulating jumpers on the control panel 150, or a default balance point temperature value may be provided by the control panel 150. The balance point temperature corresponds to the outside ambient temperature greater than which it is optimal, for reasons based on operating costs or heating capacity, to operate the HVAC system 100 in the heating mode using the compressor 102 and to prevent the operation of the auxiliary heater 124. Under this control, the control panel 150 prevents the auxiliary heater 124 from operating when the outside ambient temperature is greater than the balance point temperature.

However, the control system of the present invention provides additional controls for the HVAC system 100 in addition to the balance point temperature control. The control system can override the balance point temperature control if heating requirements are not satisfied within a predetermined time period, which is discussed in further detail below, or immediately upon detection of certain conditions or malfunctions. For example, if the compressor 102 has a diagnostic module (not shown) that notifies the control panel 150 when the compressor 102 is non-functional, and the control system automatically overrides the restriction on auxiliary heat by the balance point temperature control.

Additionally, when the thermostat provides control signals to the control panel 150, the control system can override the restriction on auxiliary heat by the HVAC system 100 if the indoor temperature is less than a predetermined temperature, such as 50° F. However, this indoor temperature restriction can be subject to a further restriction, such as an outdoor ambient temperature. For example, if the indoor temperature is 50° F., but the outdoor temperature is greater than a predetermined temperature, such as 40° F., there should be no danger of damage to the structure due to water freezing, and thus, the restriction on auxiliary heat by the heating system is maintained. The outdoor restriction ambient temperature can be measured by a temperature-sensing device, such as a sensor 152 of known construction, which provides signals corresponding to the outdoor ambient temperature to the control panel 150 that can be located in the thermostat or near a component of the HVAC system 100.

During heating mode operation of the HVAC system 100, the compressor 102 is preferably operated at the stage one level during times when the heating demand in the interior space is low. As the heating demand in the interior space increases in response to a variety of factors such as the exterior temperature, the stage two level is activated or engaged. Typically, operation of the stage two compressor 102 and auxiliary heater 124, when needed, provides the maximum amount of heating capacity from the HVAC system 100, although additional auxiliary or supplemental heat sources, such as a second auxiliary heater 124, or baseboard heaters, also may be used. Typically, the auxiliary heater 124 has one heating element, and can provide heating when required. Alternately, the auxiliary heater 124 can have a first heating element, and an independently operable second heating element, which heating elements can be selectively energized depending on the heating demand.

A control program or algorithm executed by a microprocessor, or control device, or control panel 150 is used to control the operation of the HVAC system 100. The control program, which can preferably be stored in a thermostat or any of the components of the HVAC system 100, determines when the auxiliary heater 124 or the stage two level of compressor 102 is to be started in response to the higher heating demand. The control program can receive a variety of possible inputs, such as temperature, pressure and/or flow measurements, in order to control operation of the HVAC system 100. It is to be understood that the particular control program and control criteria for engaging and disengaging particular components of the HVAC system 100 can be selected and based on the particular performance requirements of the HVAC system 100 desired by a user of the HVAC system 100.

The HVAC system 100 shown in FIG. 1 operates as follows when in the heating mode. The compressor 102 compresses a refrigerant vapor and delivers the compressed refrigerant vapor to a corresponding condenser 112 by a discharge line. The condenser 112 can include heat-exchange coils. A fluid, preferably air, travels or passes over and around the heat-exchanger coil of the condenser 112. Once the air passes through the condenser 112, it is blown by blower 118 to the interior space via a supply duct 120. The vapor refrigerant in the condenser 112 enters into a heat exchange relationship with the air passing through and over the condenser 112 to heat or raise the temperature of the air before it is provided to the interior space by the blower 118 and the supply duct 120. The refrigerant vapor in the condenser 112 undergoes a phase change to a refrigerant liquid as a result of the heat exchange relationship with the air passing through the condenser 112.

Upon leaving the condenser 112, the condensed liquid refrigerant passes through an expansion valve 116 and is partially transformed into a vapor prior to flowing to evaporator 106. The refrigerant liquid and vapor delivered to the evaporator 106 enters into a heat exchange relationship with a fluid, preferably air, flowing over a heat-exchanger coil in the evaporator 106 and is converted to a vapor. To assist the passage of the fluid over and around the heat-exchanger coils of the evaporator 106, a fan 110 can be used to force air over the coils of the evaporator 106. The vapor refrigerant in the evaporator 106 then returns to the compressor 102 to complete the cycle. The conventional HVAC system 100 includes many other features that are not shown in FIG. 1. These features have been purposely omitted to simplify the drawing for ease of illustration.

An alternate source of heat is the auxiliary heater 124, which typically comprises a series of electrically resistive heating elements positioned within the supply duct 120. If the auxiliary heater 124 is a two-stage heater, the auxiliary heater 124 has two independently operable sets of heating elements, as previously discussed. Upon instruction from the control panel 150, electrical current is supplied to the heating elements, which become heated due to their electrical resistance to the flow of current. A flow of air supplied by the blower 118 passes in heat exchange relationship with the heated heating elements to heat or raise the temperature of the air before it is provided to the interior space.

In addition, the HVAC system 100 can include one or more sensors 122 for detecting and measuring operating parameters of the HVAC system 100. The signals from the sensors 122 can be provided to a microprocessor, or control device, or control panel 150 that controls the operation of the HVAC system 100 using the control programs discussed above. Sensors 122 can include pressure sensors, temperature sensors, flow sensors, or any other suitable type of sensor for evaluating the performance of the HVAC system 100.

The control panel 150 executes a control system that uses control algorithm(s) or software to control operation of the HVAC system 100 and to determine and implement operating controls for the compressor 102 in response to a particular output capacity requirement for the HVAC system 100. In one embodiment, the control algorithm(s) can be computer programs or software stored in the non-volatile memory of the control panel 150 and can include a series of instructions executable by the microprocessor of the control panel 150. While it is preferred that the control algorithm be embodied in a computer program(s) and executed by the microprocessor, it is to be understood that the control algorithm may be implemented and executed using digital and/or analog hardware by those skilled in the art.

To control the HVAC system 100, the control panel 150, which may be located in any of the components, such as the thermostat, may receive input signals from temperature input devices, such as the indoor temperature from the thermostat and/or outdoor ambient temperature from the sensor 152. Upon receiving these temperature signals, the control panel 150 compares the temperatures, or receives the results of the temperature comparison from another component, such as the thermostat, and provides feedback control to components as determined by the control system of the control panel 150. The control panel 150 can receive input signals indicating a demand for stage one heating or stage two heating by the compressor 102, stage one heating or stage two heating by the auxiliary heater 124, or any combination of stages of the compressor and auxiliary heater. The control panel 150 also receives signals from sensors 122 indicating the performance of the HVAC system 100. The control panel 150 then processes these input signals using the control method of the present invention and generates the appropriate control signals to the components of the HVAC system 100 to obtain the desired control response to the received input signals.

Figure 3:
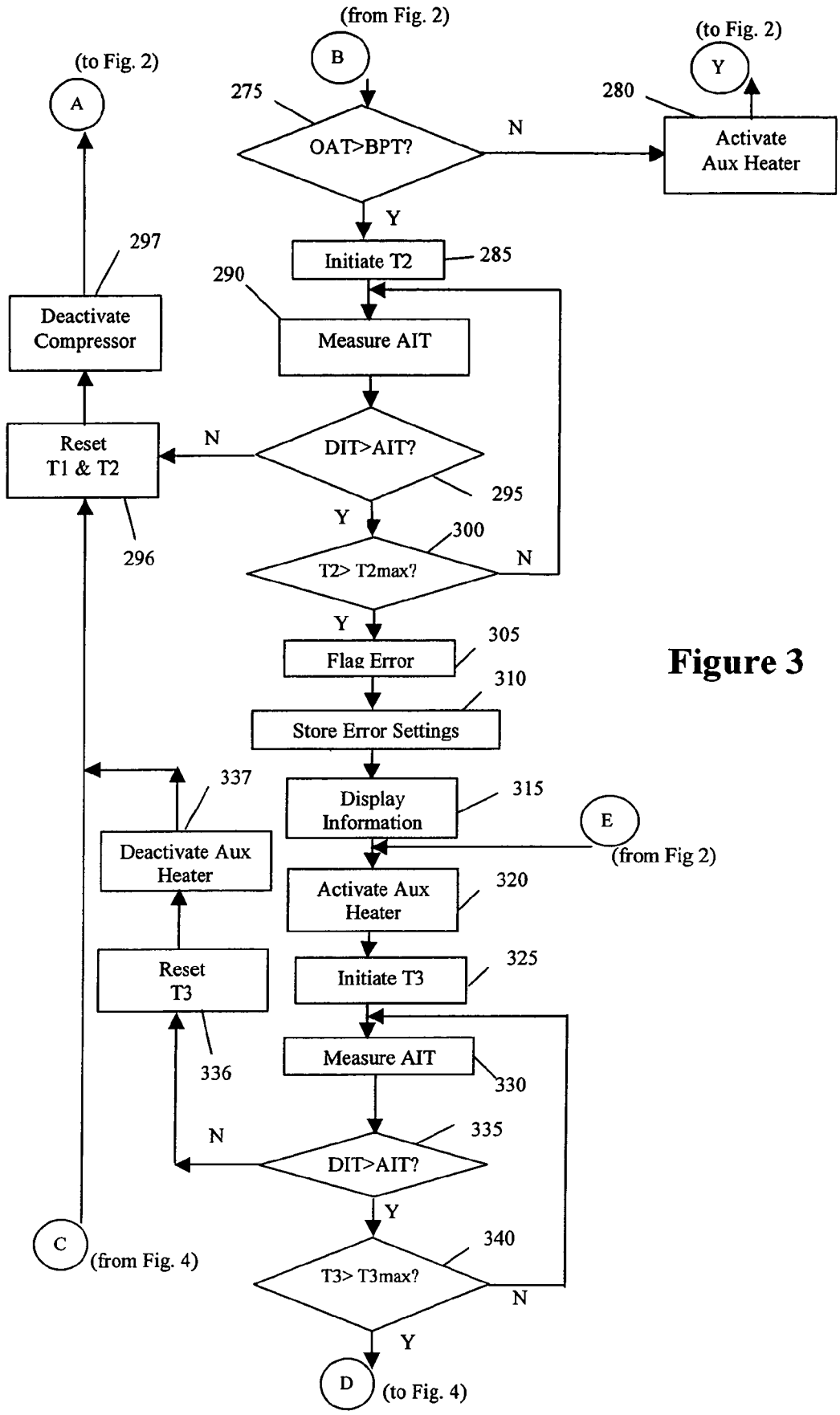
Figure 4:
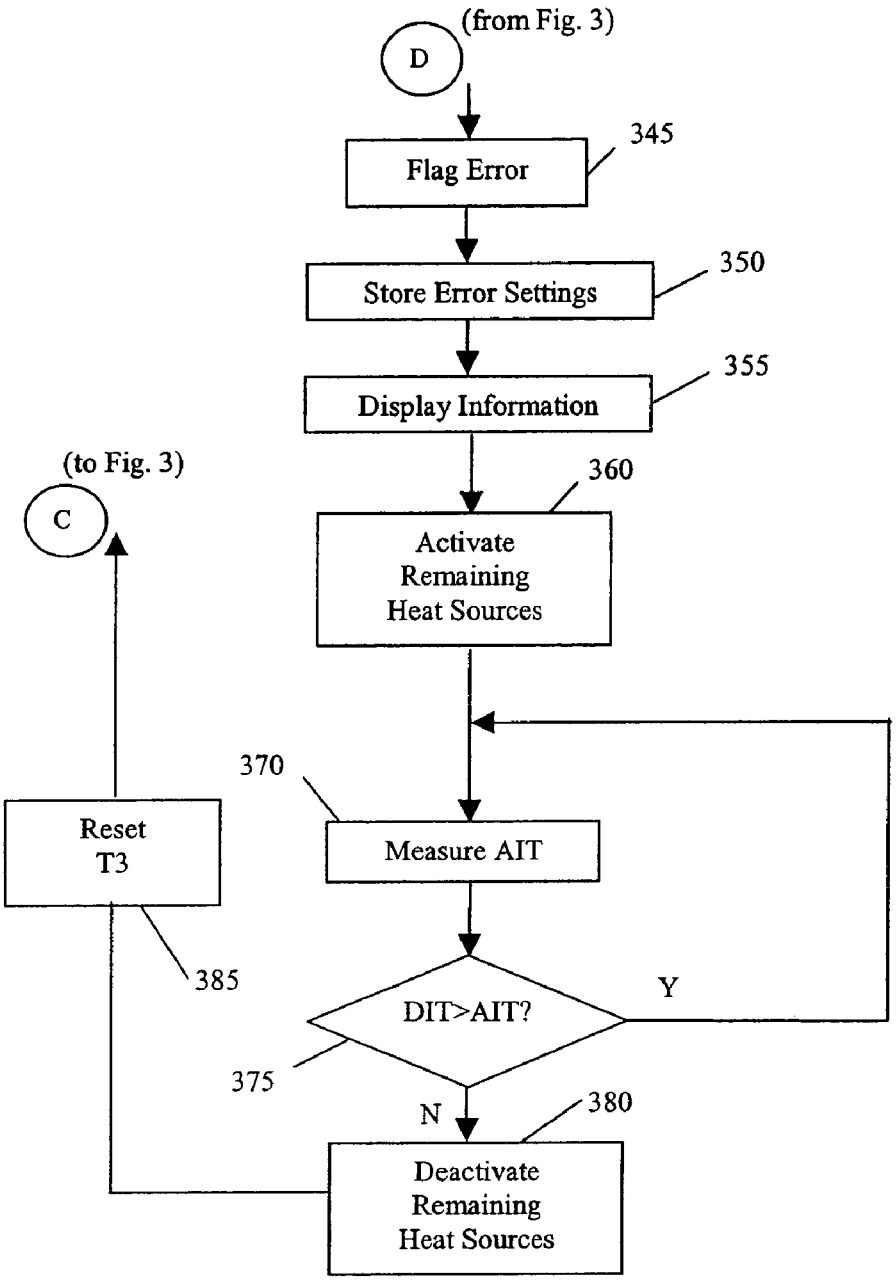

FIGS. 2–4 illustrate a flow chart detailing the control process of the present invention relating to heating control in a HVAC system 100, as shown in FIG. 1, wherein control is maintained by the thermostat (not shown). The heating control process of FIG. 2 can also be implemented as a separate control program executed by a microprocessor, or control device, or control panel 150 or the control process can be implemented as a sub-program in the control program for the HVAC system 100. The process begins with the selection of the balance point temperature ("BPT") in step 205 which may be performed by inputting or entering the desired temperature into the thermostat, by manipulating a jumper position on a board in the control panel 150, or by using the default temperature value from the control panel 150. Once the balance point temperature has been selected, a desired inside temperature ("DIT") in step 210 is preferably selected by inputting or entering the temperature into the thermostat. The actual inside temperature ("AIT") is measured in step 215. The desired inside temperature is then compared with the actual inside temperature in step 220 to determine whether the desired inside temperature is greater than the actual inside temperature. If the desired inside temperature is not greater than the actual inside temperature, there is no current need for heat, and the compressor 102 and auxiliary heater 124 are deactivated, if previously activated, in step 225. If the desired inside temperature is greater than the actual inside temperature, a need for heating exists, and a signal from the thermostat is transmitted to the control panel 150, which is preferably inside the thermostat, and a control signal is provided in step 230 to activate the compressor 102.

Once the compressor 102 has been activated, the compressor 102 is monitored to determine if the compressor 102 is functioning properly in step 231, such as by a diagnostic module, that notifies the control panel 150 when the compressor 102 is non-functional or functioning improperly. However, it is to be understood that the diagnostic module may be used to sense or determine if any other component, connection between components or parameter of the refrigerant heating circuit of the HVAC system 100 is not functioning properly or is improper, such as a sufficiently low level of refrigerant, and likewise notify the control panel 150 of the non-functional or improperly functional operational status. If the compressor 102 is functioning improperly, an error is flagged in step 232, and then error settings are stored in step 233, that is, any component or heating system control settings associated with the error code are stored in step 233. Additionally, evidence of the error is displayed on the thermostat in step 234 for benefit of the user, typically in the form of an error message listed on the thermostat display, or a light emitting diode ("LED") begins flashing in a patterned sequence that corresponds to the particular error. Once the error code is displayed, control proceeds to step 320 (see FIG. 3), which activates the auxiliary heater 124. If the compressor is not malfunctioning, a timer, T1, is initiated in step 235, which corresponds to a predetermined amount of time, such as ten minutes, which is the maximum permissible time duration T1MAX. It is understood that the time duration T1MAX can range widely, however, from less than about five minutes to greater than about 30 minutes. The time period is measured from the activation of the compressor 102 to the moment the heating requirement of step 220 is satisfied, the heating requirements, or demand, being satisfied solely by operation of the compressor 102 in the HVAC system 100. Once timer T1 is initiated, the difference between the desired indoor temperature and the actual indoor temperature is calculated in step 240. If the temperature difference is sufficiently large, such as five degrees or more, although such difference can be as low as about two degrees or less, the heating system may automatically activate the auxiliary heater 124, or at least activate the second stage of the compressor 102, since the first stage of compressor 102 may not provide sufficient heating capacity to satisfy the heating requirements within the permissible duration of timer T1.

Upon completing the temperature calculation in step 240, an inquiry is conducted in step 245 to determine if any of the following have occurred: has T1 exceeded the predetermined amount of time T1MAX?; does the difference between the desired indoor temperature and the actual indoor temperature exceed a predetermined maximum ΔTMAX?; or has the auxiliary heater been manually enabled or activated by the user activating a switch or buttons on the thermostat? If none of the conditions of step 245 are satisfied, control returns to step 215. However, if at least one of the conditions of step 245 is satisfied, the actual indoor temperature is measured in step 250.

After the actual indoor temperature is measured, the desired inside temperature is then again compared with the actual inside temperature in step 255 (which is similar to step 220) to determine whether the desired inside temperature is still greater than the actual inside temperature even after compressor operation has started. If the desired inside temperature is not greater than the actual inside temperature, then there is no current need for heat, and T1 is reset in step 260 and the compressor 102 and auxiliary heater 124, if previously activated, are deactivated, in step 225 and control returns to step 215. However, if the desired inside temperature is still greater than the actual inside temperature, there is still a current need for heat, and the outside ambient temperature ("OAT") is measured in step 270. Once the outside ambient temperature is measured, the outside ambient temperature is compared to the balance point temperature in step 275 as shown in FIG. 3. If the outside ambient temperature is not greater than the balance point temperature, the auxiliary heater 124 is activated in step 280, and control is returned to step 215. This is true for HVAC systems 100 having electrical resistance auxiliary heaters. Alternately, for HVAC systems having fossil fuel auxiliary heaters, when the auxiliary heater is activated, the compressor is typically de-energized. However, if the outside ambient temperature is greater than the balance point temperature in step 275, a timer, T2, is initiated in step 285 of FIG. 3. When the outside ambient temperature is greater than the balance point temperature, the compressor 102 (heat pump) operates to provide heat more efficiently, and thus more economically, than the auxiliary heater 124. Therefore, the HVAC system 100 in the heating mode of operation does not activate or prevents the activation of the auxiliary heater 124.

The timer T2, which is initiated in step 285, corresponds to a predetermined time duration T2MAX, such as an hour, for the heating system to satisfy the heating demand without activating the auxiliary heater 124. Furthermore, there may be other ways or conditions that may result in the auxiliary heat restriction based on balance point to be overridden. For example, it is possible to override the balance point immediately if a signal is received from the diagnostic module of the compressor indicating that the compressor has failed, as previously discussed in step 231. Also, it may also be possible to immediately override the balance point restriction if the indoor temperature is less than a certain value, such as about 32° F. or about 40° F. While timer T2 is based on the time that the control is actually trying to operate the compressor (compressor run time or accumulated compressor run time), there may be other alternate timing reference frameworks. For example, a timer could be based on compressor run time, such as timer T2, or real time if the control had a real time clock, such as those typically used on the thermostat.

Upon timer T2 being initiated in step 285, the actual indoor temperature is measured in step 290. Once the actual indoor temperature is measured, the desired inside temperature is compared to the actual indoor temperature in step 295. If the desired inside temperature is not greater than the actual indoor temperature, the heating demand is satisfied, the timers T1 and T2 are reset in step 296, the compressor 102 is deactivated in step 297, and control is returned to step 215. However, if the desired inside temperature is greater than the actual indoor temperature, indicating the heating demand is not satisfied, a comparison is then made in step 300 to determine whether the timer T2 has exceeded the maximum permissible value of T2, or T2MAX. If T2 does not exceed T2MAX, control is returned to step 290. However, if T2 exceeds T2MAX, an error code is flagged in step 305, and error settings are stored in step 310, that is, any component or heating system control settings associated with the error code are stored in step 310. Additionally, evidence of the error is displayed on the thermostat in step 315 for benefit of the user, typically in the form of an error message listed on the thermostat display, or a light emitting diode ("LED") begins flashing in a patterned sequence that corresponds to the particular error.

Once the error is displayed, the auxiliary heater 124 is activated in step 320. The auxiliary heater 124 is activated in step 320 despite the balance point setting, which occurs once the predetermined time duration T2MAX has been exceeded without satisfying the heating requirements. By overriding the balance point setting, the auxiliary heater 124 is activated to provide supplemental heat, which auxiliary heater 124 activation normally being prevented by the HVAC heating system. In other words, if the heat pump is malfunctioning, but not detected in step 231, the control system, after permitting the heat pump a predetermined time T2MAX to satisfy the heating requirements, activates auxiliary heater 124 to help prevent damage to the interior space being heated by the HVAC system. Such damage could occur if the balance point temperature setting was sufficiently low, such as 0° F., and the outdoor ambient temperature was sustained for a period of time at a level somewhat greater than the balance point temperature, such as 10° F. If these environmental conditions were to persist for a sufficient time, without the control system of the present invention, a malfunctioning compressor could cause the indoor temperature to drop to a value that is less than a predetermined value which could damage the interior space, such as 32° F., possibly resulting in ruptured pipes, due to the expansion of water inside the pipes as the water freezes. Therefore, depending upon the interior space, or contents within the interior space, it is also possible that causing the indoor temperature to drop to a value that is greater than 32° F. could damage the interior space. It is understood that the term "interior space" also includes the contents within the interior space.

After the auxiliary heater is activated in step 320, a timer, T3, is initiated in step 325. Timer T3 measures the elapsed time from the activation of the auxiliary heater 124 until either the heating requirement is satisfied, or a predetermined time duration has elapsed. The maximum time duration is T3MAX. Upon the initiation of the timer T3, the actual inside temperature is measured in step 330. After the actual inside temperature is measured, the desired inside temperature is compared to the actual inside temperature in step 335. If the desired inside temperature is not greater than the actual inside temperature, the heating requirement has been satisfied, timer T3 is reset in step 336, the auxiliary heater 124 is deactivated in step 337, timers T1 and T2 are reset in step 296, the compressor 102 is deactivated in step 297, and control is returned to step 215. However, if the desired inside temperature is greater than the actual inside temperature, the heating load has not been satisfied, and elapsed time of timer T3 is compared to the maximum time duration T3MAX in step 340. If the elapsed time of timer T3 is not greater than the maximum time duration T3MAX, control is returned to step 330. However, if the elapsed time of timer T3 is greater than the maximum time duration T3MAX, an error is flagged in step 345, as shown in FIG. 4, error settings are stored in step 350, and information apparent to the user is displayed in step 355, as previously discussed.

Once the error is displayed, any remaining heat sources are activated in step 360 of FIG. 4 to provide heating to satisfy the heat load. In other words, the heating system could be configured to originally activate each of the compressor 102 and the auxiliary heater 124 at its respective first stage capacity. Thus, the remaining heat sources could include the second stage capacities (or additional stages) of each of the compressor 102 and auxiliary heater 124. Alternately, the heating system could also sequentially activate the first stage of compressor 102, then activate the second stage of compressor 102 prior to activating the auxiliary heater 124, or any other combination of compressor and auxiliary heater stages. Further, the remaining heat source could also include additional compressors or auxiliary heat sources. Upon activation of the remaining heat sources in step 360, the actual inside temperature is measured in step 370.

After the actual inside temperature is measured, the desired inside temperature is compared to the actual inside temperature in step 375. If the desired inside temperature is not greater than the actual inside temperature, the heating requirement has been satisfied, and the remaining heat sources are deactivated in step 380, timer T3 reset in step 385, timers T1 and T2 are reset in step 296, the compressor 102 is deactivated in step 297, and control is returned to step 215. However, if the desired inside temperature is greater than the actual inside temperature, the heating requirement has not been satisfied, and control is returned to step 370. Therefore, so long as the desired inside temperature is greater than the actual inside temperature, the heating system defines a repeating loop. This is because the heating system will continue to try to satisfy the heating requirements even if it is unable to do so. However, by attempting to satisfy the heating requirements, the heating system may achieve a stable indoor temperature that is sufficiently greater than 32° F. to avoid damage to the interior space of the structure caused by water freezing.

Additionally, the heating system can also incorporate features related to inside temperature and/or ambient outdoor temperature to limit the forced operation of the auxiliary heater. For example, one feature could limit the forced operation of the auxiliary heater based upon a minimum inside temperature. That is, if the heating requirements are not satisfied, but the inside temperature has not fallen to a value which is less than a predetermined level, such as 50° F., the portion of the heating system override in which the auxiliary heater is activated in step 320 will not operate. Further, the heating system can also incorporate a feature that limits the forced operation of the auxiliary heater based upon either a predetermined ambient outdoor temperature or a combination of a predetermined ambient outdoor temperature and a predetermined indoor temperature.

An example of the feature of limiting the forced operation of the auxiliary heater based upon a predetermined outdoor ambient temperature is that the heating requirements of the inside space have not been satisfied, such as an actual indoor temperature of 65° F. when the desired indoor temperature is 68° F., but the outdoor ambient temperature is sufficiently greater than a predetermined level, such as 32° F. Since the outdoor ambient temperature cannot result in water freezing inside the enclosed space of the structure being heated, the outdoor ambient temperature may be the sole basis for limiting the forced operation of the auxiliary heater. Alternately, a predetermined outdoor ambient temperature, such as sufficiently greater than 32° F. as discussed above, may be combined with a predetermined indoor temperature, such as greater than 50° F., so that both temperature parameters must be satisfied in order for the heating system override discussed above to force operation of the auxiliary heater. Although 50° F. was selected as the predetermined indoor temperature, this selection was arbitrarily, and could be widely varied from as low as about 35° F. to at least 75° F.

While FIGS. 2–4 are associated with detailing the control process of the present invention relating to heating control in a HVAC system, wherein control is maintained by the thermostat, with relatively minor changes to FIGS. 2–4, the control process can be maintained by a controller in or adjacent the compressor or any other component associated with the HVAC system. For example, if the control panel 150 is remotely situated from the thermostat, the thermostat measures and compares the desired indoor temperature with the actual indoor temperature, generating a signal to the control panel 150 when there is a demand for heat. The sensor 152, for instance, which senses outdoor ambient temperature, may directly provide signals to the control panel 150 with temperature information. In other words, the control panel 150 may or may not be required to measure temperatures, but may simply execute the control system in response to HVAC system heating demands received from other components. However, the HVAC system control of the present invention, can force the auxiliary heater to operate irrespective the controlling component.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A control system for selectively providing heat to an interior space comprising:

a control panel configured to control a HVAC system having a compressor, a condenser and an evaporator connected in a closed refrigerant loop, and an auxiliary heater controllable independently of the HVAC system, the control panel comprising:

a first sensor to measure an ambient outside temperature;

a control device, the control device receiving a demand for heating the interior space from the HVAC system based on the interior space being less than a first predetermined indoor temperature; and a storage device storing a predetermined balance point temperature associated with the HVAC system; and the control device being configured to engage the auxiliary heater in response to the ambient outside temperature being greater than the predetermined balance point temperature and the satisfaction of at least one predetermined criteria related to the HVAC system, and wherein the at least one predetermined criteria including upon the control panel determining the ambient outside temperature being greater than the predetermined balance point temperature and at least one of the HVAC system being enabled for a predetermined time and the indoor temperature of the interior space being less than a second predetermined temperature, unless the ambient outside temperature is greater than third predetermined temperature, wherein the control device is prevented from engaging the auxiliary heater.

2. The control system of claim 1 wherein the at least one predetermined criteria includes the HVAC system being operated for a predetermined time.

3. The control system of claim 2 wherein the predetermined time is a compressor run time.

4. The control system of claim 1 wherein the at least one predetermined criteria includes an indoor temperature of the interior space being less than a predetermined indoor temperature.

5. The control system of claim 1 wherein the control panel is incorporated in a controller.

6. The control system of claim 1 wherein the control panel is incorporated in a thermostat.

7. The control system of claim 1 wherein the ambient outside temperature is less than a value that can damage the interior space.

8. The control system of claim 7 wherein the ambient outside temperature is less than about 32° F.

9. The control system of claim 1 wherein the at least one predetermined criteria including upon the control panel determining the HVAC system functioning improperly, the control panel enables the auxiliary heater without regard to the at least one of the HVAC system being enabled for a predetermined time and the indoor temperature of the interior space being less than a second predetermined temperature.

10. The control system of claim 9 wherein the control panel includes a diagnostic module to determine if the HVAC system is functioning improperly.

11. The control system of claim 1 wherein the third predetermined temperature is greater than a value that can result in damage to the interior space.

12. An HVAC system for an interior space, the HVAC system comprising:

a compressor, a condensor and an evaporator connected in a closed refrigerant loop;

an auxiliary heater controllable independently of the refrigerant loop;

a control panel configured to control the HVAC system, the control panel comprising:

a first sensor to measure an ambient outside temperature;

a second sensor to measure an indoor temperature of the interior space;

a control device; and a storage device storing a predetermined balance point temperature associated with the HVAC system; and the control device being configured to engage the auxiliary heater in response to the ambient outside temperature being greater than the predetermined balance point temperature and the satisfaction of at least one predetermined criteria related to the HVAC system, and wherein the control panel being configured to determine if the ambient outside temperature is greater than the predetermined balance point temperature and wherein the at least one of the predetermined criteria including HVAC system being enabled for a predetermined time and the indoor temperature of the interior space being less than a second predetermined temperature, unless the ambient outside temperature is greater than a third predetermined temperature, wherein the control device is prevented from engaging the auxiliary heater.

13. The HVAC system of claim 12 wherein the at least one predetermined criteria includes the HVAC system being operated for a predetermined time.

14. The HVAC system of claim 13 wherein the predetermined time is a compressor run time.

15. The HVAC system of claim 12 wherein the at least one predetermined criteria includes an indoor temperature of the interior space being less than a predetermined indoor temperature.

16. The HVAC system of claim 13 wherein the ambient outside temperature is less than a value that could result in damage to the interior space.

17. The HVAC system of claim 16 wherein the ambient outside temperature is less than about 32° F.

18. The HVAC system of claim 13 wherein the control panel being configured to determine if the HVAC system is functioning improperly, the control panel being configured to enable the auxiliary heater without regard to at least one the HVAC system being enabled for a predetermined time and the indoor temperature of the interior space being less than a second predetermined temperature.

19. The HVAC system of claim 18 wherein the control panel includes a diagnostic module to determine if the HVAC system is functioning improperly.

20. The HVAC system of claim 12 wherein the third predetermined temperature is greater than a value that could result in damage to the interior space.

* * * * *

UNITED STATES PATENT AND TRADEMARK OFFICE

CERTIFICATE OF CORRECTION

PATENT NO. : 7,085,626 B2
APPLICATION NO. : 10/824804
DATED : August 1, 2006
INVENTOR(S) : Harrod et al.

It is certified that error appears in the above-identified patent and that said Letters Patent is hereby corrected as shown below:

In column 11, line 47 “than third” should be -- than a third --,

In column 12, line 41 “including HVAC” should be -- including the HVAC --,

In column 12, line 57 “claim 13” should be -- claim 12 --,

In column 12, line 63 “claim 13” shoud be -- claim 12 --.

Signed and Sealed this

Tenth Day of October, 2006

JON W. DUDAS
*Director of the United States Patent and Trademark Office*